US007287290B2

(12) United States Patent
Romano et al.

(10) Patent No.: US 7,287,290 B2
(45) Date of Patent: Oct. 30, 2007

(54) MATTRESS HAVING AN AIR PRESSURE INDICATOR

(75) Inventors: James J. Romano, James Island, SC (US); William L. Jacques, II, Mt. Pleasant, SC (US)

(73) Assignee: Hill-Rom Services, Inc., Wilmington, DE (US)

( * ) Notice: Subject to any disclaimer, the term of this patent is extended or adjusted under 35 U.S.C. 154(b) by 76 days.

(21) Appl. No.: 11/232,715

(22) Filed: Sep. 22, 2005

(65) Prior Publication Data

US 2006/0059630 A1 Mar. 23, 2006

Related U.S. Application Data

(60) Provisional application No. 60/612,434, filed on Sep. 23, 2004.

(51) Int. Cl.
*A47C 27/08* (2006.01)

(52) U.S. Cl. ..... 5/706; 5/713

(58) Field of Classification Search ..... 5/706–715
See application file for complete search history.

(56) References Cited

U.S. PATENT DOCUMENTS

| | | | | |
|---|---|---|---|---|
| 3,644,950 | A * | 2/1972 | Lindsay, Jr. | 5/709 |
| 3,784,994 | A * | 1/1974 | Kery | 5/710 |
| 3,822,425 | A * | 7/1974 | Scales | 5/710 |
| 4,306,322 | A * | 12/1981 | Young et al. | 5/710 |
| 4,949,413 | A | 8/1990 | Goodwin | |
| 5,487,196 | A * | 1/1996 | Wilkinson et al. | 5/715 |
| 5,556,258 | A * | 9/1996 | Lange et al. | 417/63 |
| 5,647,079 | A | 7/1997 | Hakamiun et al. | |
| 6,223,369 | B1 * | 5/2001 | Maier et al. | 5/713 |
| 6,253,401 | B1 * | 7/2001 | Boyd | 5/713 |
| 6,483,264 | B1 * | 11/2002 | Shafer et al. | 318/16 |
| 6,848,135 | B1 * | 2/2005 | Kohlman | 5/654 |

OTHER PUBLICATIONS

Dielectrics—Disposable Manometers, (printed Apr. 27, 2004), 1 page, http://www.dielectrics.com/pages/10052.html.

* cited by examiner

*Primary Examiner*—Michael Trettel
(74) *Attorney, Agent, or Firm*—Barnes & Thornburg LLP

(57) ABSTRACT

A mattress including an air pressure indicator configured to indicate the pressure of the mattress.

7 Claims, 4 Drawing Sheets

MATTRESS HAVING AN AIR PRESSURE INDICATOR

CROSS-REFERENCE TO RELATED APPLICATION

This application claims the benefit of U.S. Provisional Patent Application Ser. No. 60/612,434, filed Sep. 23, 2004, titled MATTRESS HAVING AN AIR PRESSURE INDICATOR, the disclosure of which is expressly incorporated herein by reference.

BACKGROUND AND SUMMARY

The present invention relates to a mattress for a bed. More particularly, the present invention relates to a mattress including an indicator configured to provide an indication of the pressure of the mattress.

Beds, including mattresses, mattress overlays, mattress toppers, and mattress replacement systems having a plurality of air bladders or sacs to provide an adjustable patient support surface are well known in the art. Examples of inflatable patient supports are disclosed in U.S. Pat. No. 4,949,413 to Goodwin and U.S. Pat. No. 5,647,079 to Hakamiun et al., which are assigned to the assignee of the present invention and the disclosures of which are expressly incorporated by reference herein.

It is also known to provide hospital beds which perform functions such as the prevention/treatment of decubitus ulcers (bedsores), pulmonary rotational therapy, or percussion/vibration therapy. Additionally, it is known to use inflatable mattress with a variety of inflatable cell/zone structures. Illustrative functions of a mattress including cell/zone structures are disclosed in U.S. Provisional Application Ser. No. 60/567,215 to Balaton et. al., which is assigned to the assignee of the present invention and the disclosure of which is expressly incorporated by reference herein.

According to an illustrative embodiment of the present disclosure, a patient support apparatus is provided including a frame, a deck supported by the frame, a mattress, and a gauge. The gauge is coupled to the mattress and is configured to measure a mattress pressure. The gauge includes a push to read valve and an indicator. The indicator is configured to display a mattress pressure in response to actuation of the push to read valve.

According to another illustrative embodiment of the present disclosure, a pressure measuring device system is provided for use with a mattress. The pressure measuring device system is configured to determine a mattress pressure of the mattress. The pressure measuring device system comprises a measuring device, an indicator, and at least one sensor port coupled to the mattress and configured to receive the measuring device. The measuring device is configured to take a mattress pressure reading. The indicator is coupled to the measuring device and is configured to display the mattress pressure reading.

Additional features and advantages of the invention will become apparent to those skilled in the art upon consideration of the following detailed description of illustrated embodiments exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments described below and shown in the figures are merely exemplary and are not intended to limit the invention to the precise forms disclosed. Instead, the embodiments were selected for description to enable one of ordinary skill in the art to practice the invention.

Figure 1:
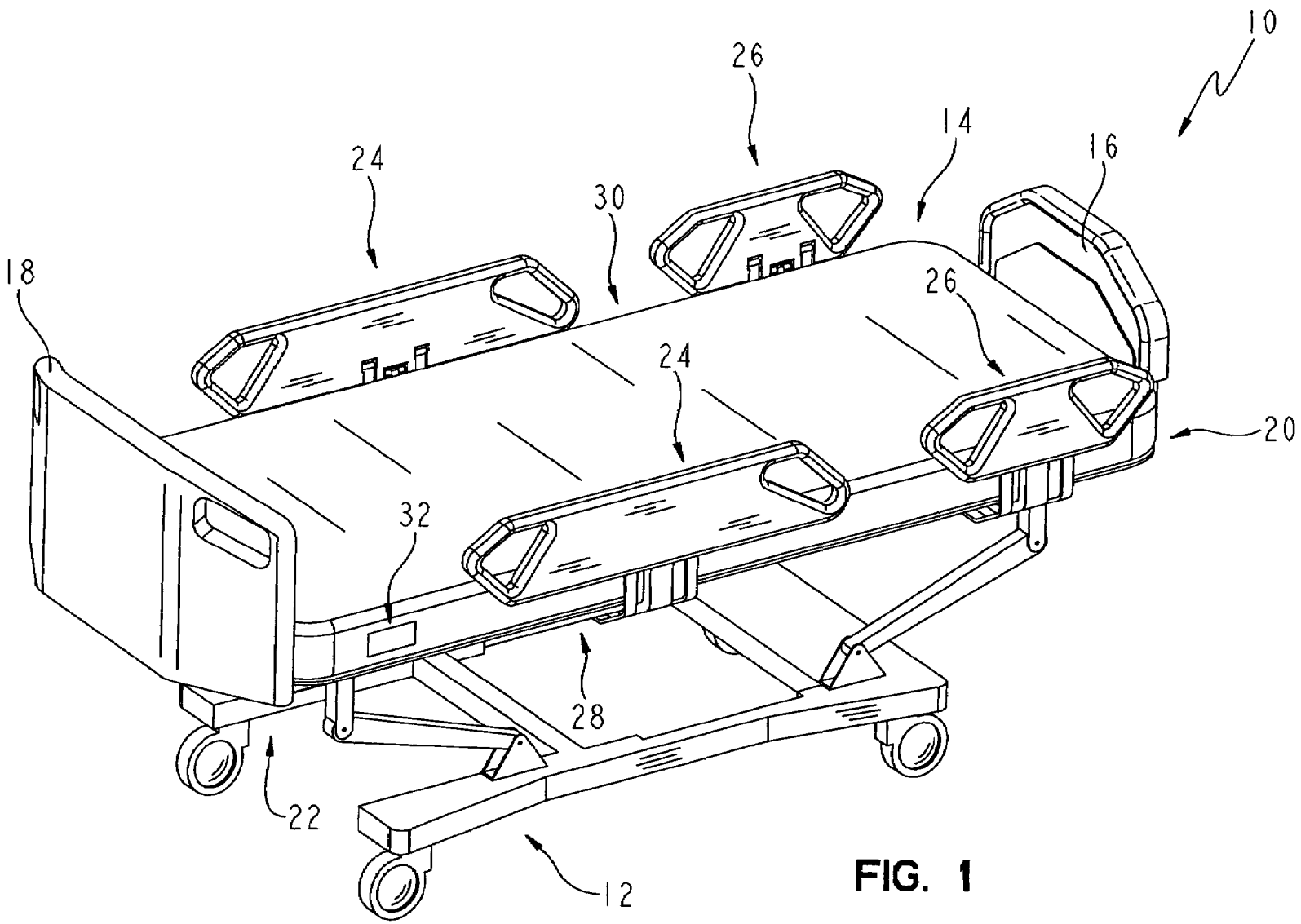
FIG. 1 is a perspective view of a patient support apparatus including a frame, a deck supported by the frame, a mattress, and at least one gauge.

As shown in FIG. 1, a patient support 10 may include a frame 12 and an inflatable mattress 14. It should be understood that patient support 10 may be a bed, a hospital bed, a stretcher, a gurney, or any other suitable device for supporting a patient. In one embodiment, mattress 14 includes a plurality of inflatable cells. In additional embodiments, mattress 14 includes a plurality of independently inflatable zones.

Patient support 10 includes a headboard 16 and a footboard 18. Headboard 16 is coupled to a first end 20 of frame 12. Footboard 18 is coupled to a second end 22 of frame 12. Patient support 10 also includes siderails 24, 26 coupled to opposite longitudinal sides 28, 30 of frame 12. Siderails 24, 26 are coupled to frame 12 to block egress of a patient from mattress 14.

In one illustrative embodiment, a gauge 32 is fluidly coupled to mattress 14 near second end 22. In FIG. 1, the gauge 32 is shown fixed to mattress 14, illustratively through radio-frequency (RF) welding. In alternative embodiments, gauge 32 is placed on individual inflatable cells, multiple zones, or anywhere on the patient support with a connection to mattress 14, such as on siderails 24, 26. In alternative embodiments, gauge 32 is snapped, glued or coupled to mattress 14 with a hook and loop fastener.

Figure 2:
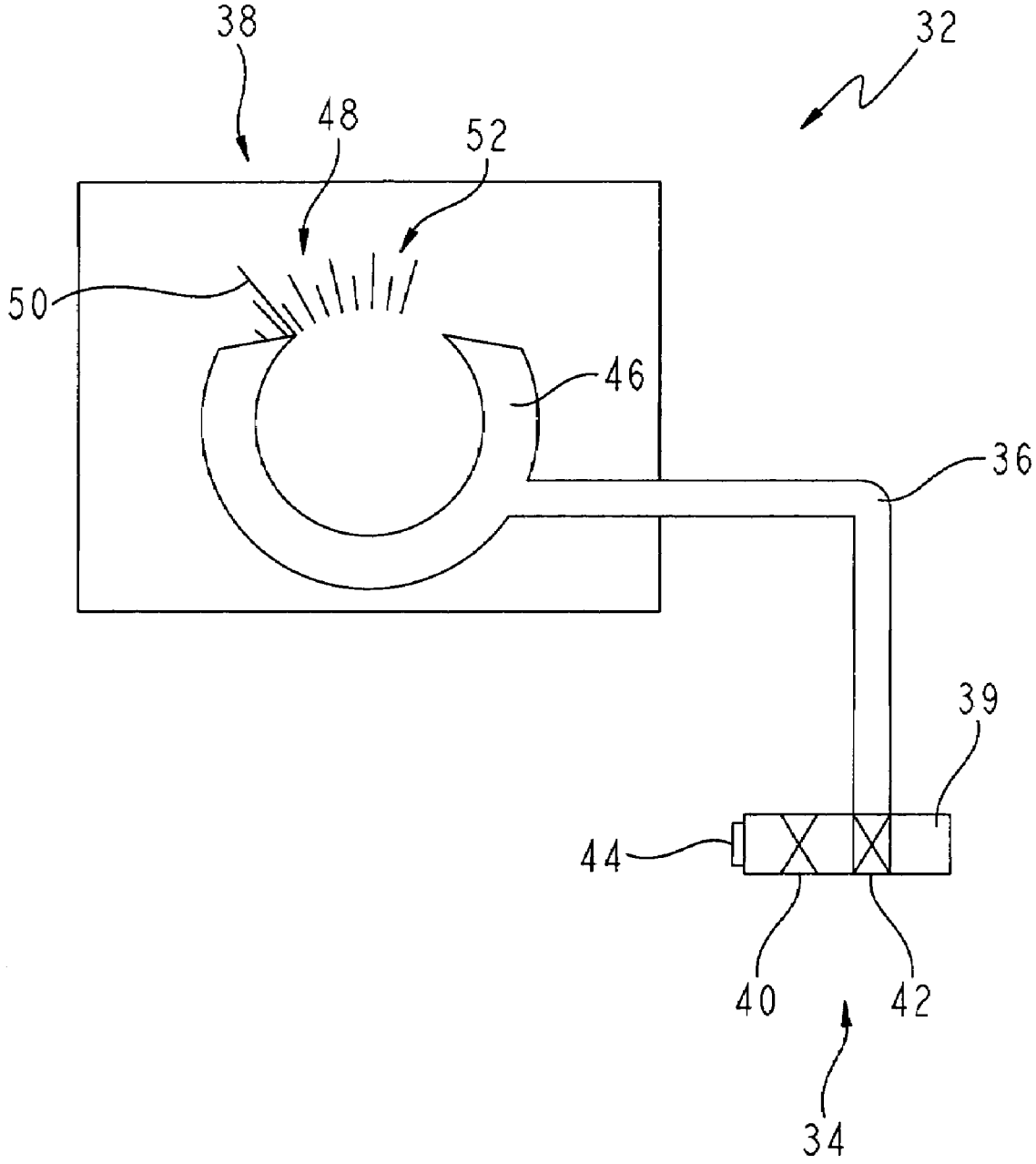
FIG. 2 is a perspective view illustrating one embodiment of the gauge.

As shown in FIG. 2, gauge 32 includes a push to read valve 34, a connector 36, and an indicator 38. In one illustrative embodiment, indicator 38 is a manometer from Dielectrics Industries. In alternative embodiments, indicator 38 could be a barometer or any other pressure sensor electrically or non-electrically (pneumatically or mechanically) operated as known to those skilled in the art of measuring pressures.

In an illustrative embodiment, connector 36 operably couples push to read valve 34 to indicator 38. Push to read valve 34 includes a body 39. Body 39 includes a mattress inlet 40, an atmosphere inlet 42, and a selector 44. Push to read valve 34 is configured to be moved from a first position wherein atmosphere inlet 42 is selected to a second position wherein mattress inlet 40 is selected. In the first position, atmosphere inlet 42 operably couples connector 36 to the atmosphere. In the second position, mattress inlet 40 operably couples connector 36 to the interior (not shown) of mattress 14 allowing indicator 38 to measure the pressure of mattress 14.

In operation from the first position to the second position, a user presses selector 44 which moves connector 36 from fluid communication with atmosphere inlet 42 to mattress inlet 40 allowing indicator 38 to measure the pressure of mattress 14. When the user (not shown) releases selector 44, push to read valve 34 disconnects from mattress inlet 40 and returns to the second position connecting connector 36 with atmosphere inlet 42. In other words, the valve 34 is vented to atmosphere in a default condition. This allows pressure changes in mattress 14 to not cause pressure spikes in indicator 38.

Indicator 38 includes a measuring portion 46 operably coupled to connector 36 and a display portion 48 configured to display the indicated mattress pressure. In one illustrative embodiment, display portion 48 includes a needle 50 configured to align with a pressure value mark 52 thereby displaying the mattress pressure when push to read valve 34 is in the second position. In an alternative embodiment, display portion includes needle 50 and a go/no-go range, wherein the go/no-go range is configured to indicate the mattress pressure is in a desired or undesired range.

Figure 3:
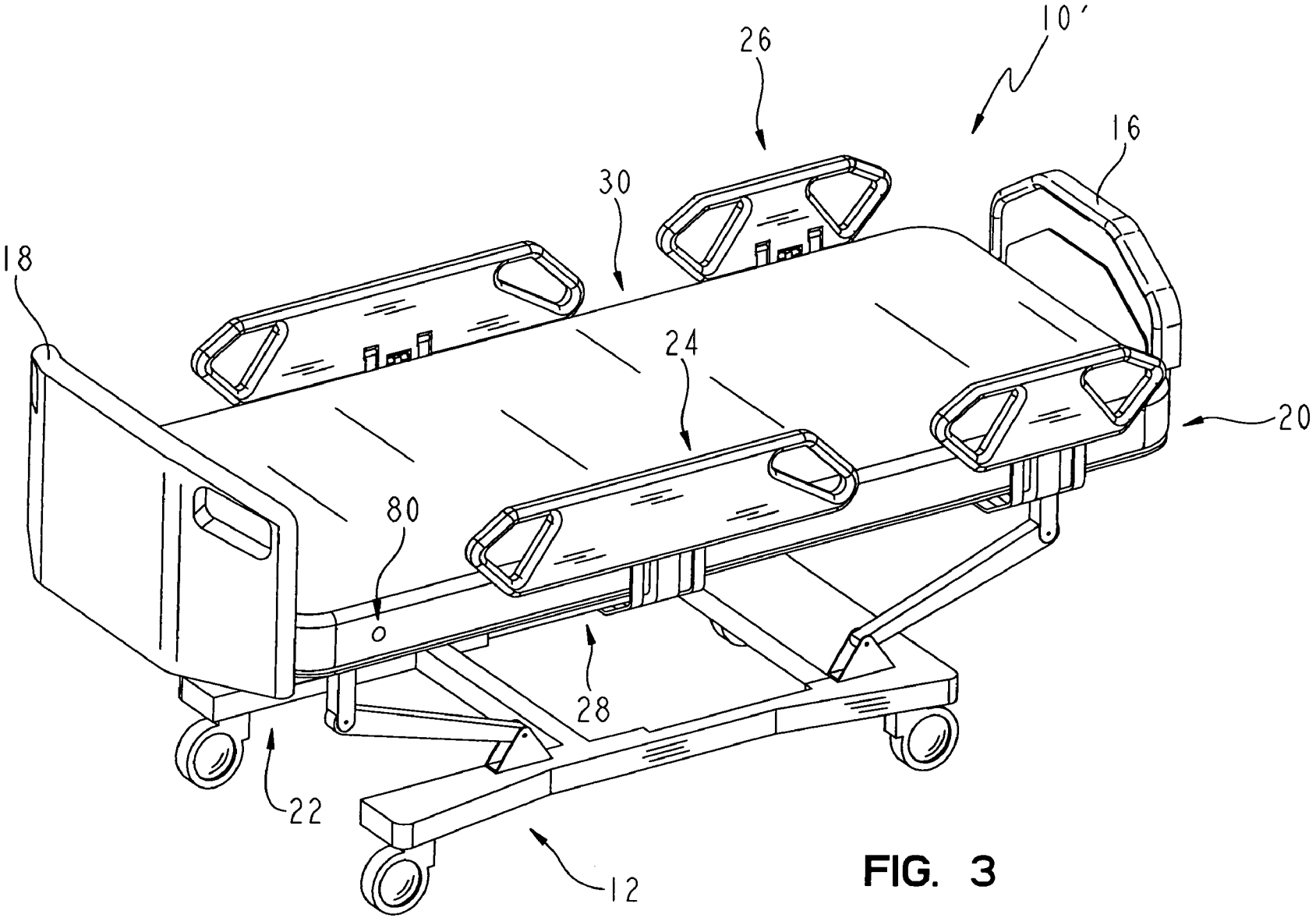
FIG. 3 is a perspective view of an alternative embodiment of a patient support apparatus including a frame, a deck supported by the frame, a mattress, and at least one sensor port.
Figure 4:
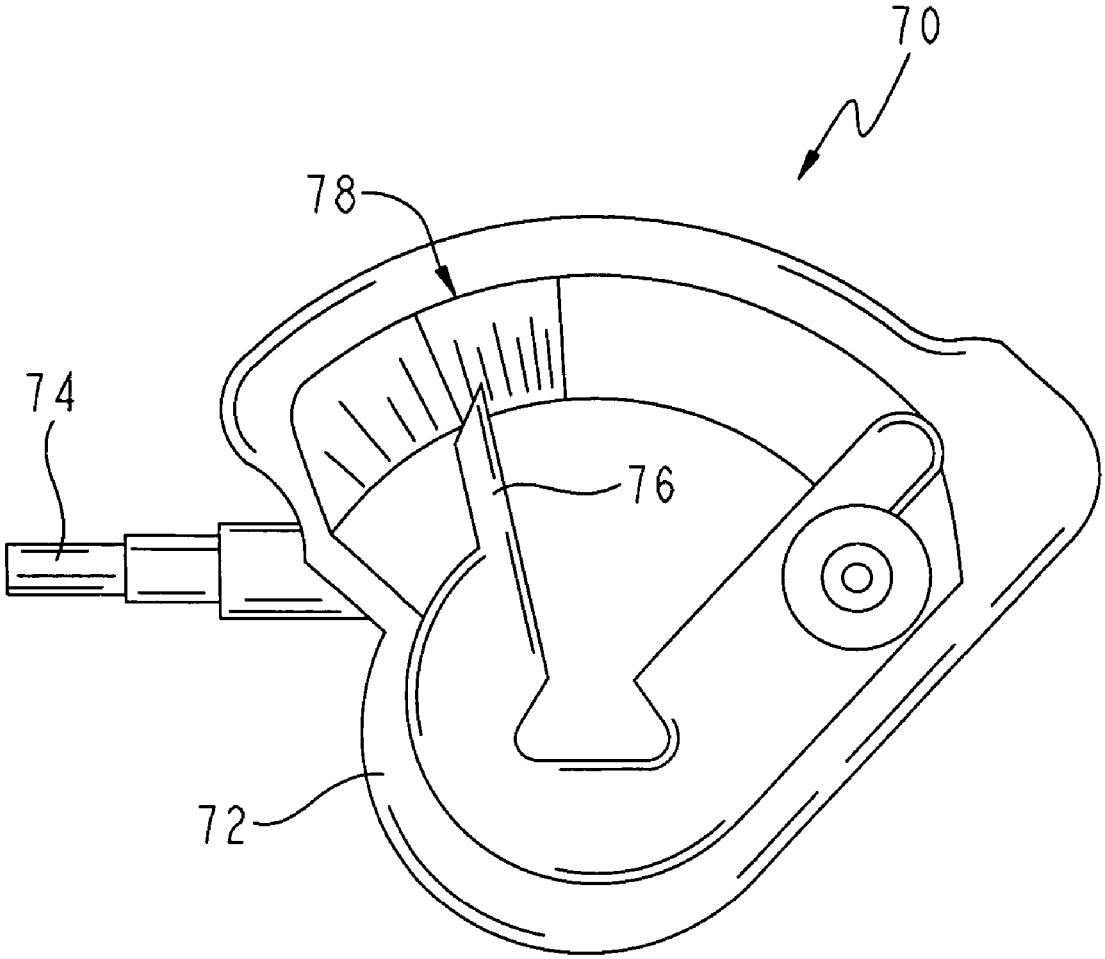
FIG. 4 is a perspective view of one embodiment of a pressure measuring device configured to couple to the at least one sensor port of FIG. 3 and measure a mattress pressure.

In another illustrative embodiment, a pressure measuring device 70 is used with a patient support 10'. As shown in FIGS. 3 and 4, pressure measuring device 70 illustratively includes a body 72, a nozzle 74, a needle 76, and a pressure display range 78. In one illustrative embodiment, pressure measuring device 70 is a disposable manometer from Dielectrics Industries of Chicopee, Mass. In alternative embodiments, indicator 38 may comprise a barometer or any other pressure sensor electrically or non-electrically (pneumatically or mechanically) operated as known to those skilled in the art of measuring pressure.

Patient support 10' is similar to patient support 10 described above. Patient support 10' includes a mattress 14'. Mattress 14' includes at least one sensor port 80 located near second end 22 of frame 12. Sensor port 80 is configured to receive nozzle 74 of pressure measuring device 70. Sensor port 80 is a quick release hose connection known to those skilled in the art and is configured to releasably couple with nozzle 74 of pressure measuring device 70. In alternative embodiments, pressure measuring device 70 is configured to read a pressure at a service port (not shown) where mattress 14' receives air from a blower (not shown). In another alternative embodiment, a plurality of sensor ports 80 are placed at various locations of mattress 14' in order to read pressures in different zones or chambers of mattress 14'.

In operation, a user places nozzle 74 into sensor port 80 allowing pressure measuring device 70 to measure the pressure of mattress 14'. With nozzle 74 in fluid communication with sensor port 80, air enters pressure measuring device 70. The air causes needle 76 to move to a pressure value mark 82 of display range 78 to display the mattress pressure of mattress 14'. When the user removes nozzle 74 from sensor port 80, sensor port 80 closes allowing only minimal air to escape, if any, from mattress 14'. In alternative embodiments, display range 78 includes a go/no-go range, illustratively bi-colored, wherein the go/no-go range is configured to indicate the mattress pressure is in a desired or undesired range.

Preferably, instructions for the assembly, installation, and/or use of gauge 32 or pressure measuring device 70 are provided with gauge 32 or pressure measuring device 70 or otherwise communicated to permit a person or machine to assemble, install and/or use gauge 32 or pressure measuring device 70. Such instructions may include a description of any or all portions of gauge 32 or pressure measuring device 70 and/or any or all of the above-described assembly, installation, and use of gauge 32 or pressure measuring device 70 or components of gauge 32 or pressure measuring device 70. The instructions may be provided on separate papers and/or on the packaging in which gauge 32 or pressure measuring device 70 are sold or shipped. These instructions may also be provided over the Internet or other communication system. Furthermore, the instructions may be embodied as text, pictures, audio, video, or any other medium or method of communicating instructions known to those of ordinary skill in the art.

Although the invention has been described in detail with reference to certain preferred embodiments, variations and modifications exist within the scope and spirit of the present invention.

The invention claimed is:

1. A patient support apparatus comprising:

a frame;

a deck supported by the frame;

a fluid-filled mattress; and a gauge coupled to the mattress and configured to measure the mattress pressure, the gauge including a push to read valve and an indicator;

wherein the indicator displays the mattress pressure in response to actuation of the push to read valve.

2. The patient support apparatus of claim 1, wherein the gauge is a manometer.

3. The patient support apparatus of claim 1, wherein the gauge is fixed to the mattress.

4. The patient support apparatus of claim 3, wherein the gauge is welded to the mattress.

5. The patient support apparatus of claim 3, further comprising a fastener, including one of a hook and loop, coupled to the mattress, to fix the gauge to the mattress.

6. The patient support apparatus of claim 1, wherein the mattress includes a plurality of inflatable cells.

7. The patient support apparatus of claim 6, further comprising a plurality of gauges wherein each of the plurality of gauges is coupled to one of the plurality of inflatable cells.

* * * * *